United States Patent [19]

Furukawa et al.

[11] Patent Number: 5,044,287

[45] Date of Patent: Sep. 3, 1991

[54] METHOD OF CONTROLLING COMBUSTION IN A FLUIDIZED BED FURNACE

[75] Inventors: Masaaki Furukawa; Hiroshi Yoshida; Takeyuki Naito; Keiichi Sato, all of Kanagawa, Japan

[73] Assignee: Ebara Corporation, Tokyo, Japan

[21] Appl. No.: 537,627

[22] Filed: Jun. 13, 1990

[30] Foreign Application Priority Data

Jun. 16, 1989 [JP] Japan ..... 1-154030

[51] Int. Cl.[5] ..... F23G 5/00

[52] U.S. Cl. ..... 110/346; 110/188; 110/191; 110/204; 110/205; 110/245

[58] Field of Search ..... 110/204, 205, 206, 185, 110/186, 188, 245, 346, 191; 431/12, 115

[56] References Cited

U.S. PATENT DOCUMENTS

| | | | |
|---|---|---|---|
| 3,863,577 | 2/1975 | Steever et al. . | |
| 4,441,435 | 4/1984 | Miyamoto | 110/188 X |
| 4,512,266 | 4/1985 | Shigaki | 110/204 |
| 4,739,713 | 4/1988 | Vier et al. | 110/204 X |
| 4,766,851 | 8/1988 | Emsperger et al. | 110/206 X |

FOREIGN PATENT DOCUMENTS

| | | | |
|---|---|---|---|
| EP-A2-0204176 | 10/1986 | European Pat. Off. . | |
| EP-A1-0237712 | 9/1987 | European Pat. Off. . | |
| 0144512 | 7/1985 | Japan | 110/205 |
| 62-18510 | 2/1987 | Japan . | |
| 62-106216 | 5/1987 | Japan . | |
| 62-182516 | 8/1987 | Japan . | |
| 63-21411 | 1/1988 | Japan . | |

*Primary Examiner*—Edward G. Favors

*Attorney, Agent, or Firm*—Wenderoth, Lind & Ponack

[57] ABSTRACT

A method for controlling combustion in a furnace into which combustible material, e.g., urban refuse, industrial waste, and a controlled quantity of combustion air are fed. The furnace includes a mixing/stirring region where unburnt gas and secondary combustion air are mixed and stirred. A part of exhaust gas derived from the furnace is blown into the mixing/stirring region depending on variation in the quantity of the secondary combustion air, and a flow rate of mixture gas consists of the exhaust gas and the secondary combustion air to be fed into the mixing/stirring region is maintained within a predetermined region so that effective combustion takes place.

6 Claims, 3 Drawing Sheets

METHOD OF CONTROLLING COMBUSTION IN A FLUIDIZED BED FURNACE

BACKGROUND OF THE INVENTION

1. Field of the Invention

The present invention relates to a method of controlling combustion in a furnace of the type including a mixing/stirring region where unburnt gas and secondary combustion air are mixed and stirred together so that combustible material, e.g., urban refuse, industrial waste or the like is effectively burnt.

2. Description of the Prior Art

Generally, urban refuse, various kind of industrial waste and so forth are substantially different from each other in configuration or size. This makes it difficult to practically design and construct a combustible waste material feeding machine on a commercial basis under the condition that a quantity of waste material to be fed into a furnace per unit time is correctly maintained. In addition, urban refuse, industrial waste and so forth differ in quality, and any variation in quality and/or quantity of combustible waste material to be fed into the furnace is directly converted into a variation in quantity and/or quantity of the resulting exhaust gas. Therefore, when the furnace is provided with a fixed supply of combustion air, there arises a problem that an excess or shortage of oxygen occurs. If the furnace is operated with an insufficient quantity of oxygen, unburnt gas is discharged from the furnace. On the contrary, when the furnace is operated with an excessive quantity oxygen, i.e., an excessive quantity of combustion air, the resultant combustion gas is cooled to an undesirable extent. This means that incomplete combustion takes place with the result that unburnt gas is discharged from the furnace. In view of the aforementioned problems, to make sure that an excessive or insufficient supply of oxygen does not occur in the furnace, a density of oxygen in the resultant combustion gas is normally measured to correctly control the quantity of combustion air to be fed into the furnace.

A proposal has been heretofore made such that shape and size of a combustion chamber of the furnace be designed in a different manner so as to allow combustion air to effectively come into contact with unburnt gas and moreover the blowing speed of the combustion air is varied so that the combustion air is effectively mixed with the unburnt gas.

However, with the aforementioned conventional method of controlling combustion in a furnace, when the furnace is controlled while varying a quantity of combustion air to be fed into the furnace, the blowing speed of the combustion air varies. Thus, when the furnace is operated under conditions different from designed points, there arises another problem that the configuration of the furnace does not correctly match the blowing speed of the combustion air.

SUMMARY OF THE INVENTION

The present invention has been made with the foregoing background in mind.

An object of the present invention is to provide an improved method of controlling combustion in a furnace wherein a part of combustion air is introduced into the interior of the furnace so that a flow rate of mixture gas comprising secondary combustion air and exhaust gas to be fed to a mixing/stirring region where unburnt gas and secondary combustion air are mixed and stirred together is maintained within a predetermined range irrespective of what extent the combustion state varies.

Another object of the present invention is to provide a method of controlling combustion in a furnace such that while combustion is taking place, combustion reaction in an upper portion of a combustion chamber of the furnace is activated so that a temperature at the upper furnace region is maintained within an optimum range.

To accomplish the above objects, the present invention provides an improved method of controlling combustion in a furnace or an incinerator of the type including a combustion chamber arranged directly above a furnace bed. The lower portion of the combustion chamber is a mixing/stirring region in which unburnt gas and secondary combustion air are mixed and stirred together. The furnace is supplied with a quantity of combustible material varying per unit time and a quantity of combustion air which is controlled in response to the quantity of the combustible material, wherein a flow rate of mixture gas comprising secondary combustion air and exhaust gas to be fed to the mixing/stirring region is maintained within a predetermined range by blowing a part of the exhaust gas into the mixing/stirring region depending on the variation in the quantity of combustion air.

According to the present invention, when a part of the exhaust gas is also blown into the upper portion of the combustion chamber, and when a quantity of exhaust gas to be blown into the mixing/stirring region increases or decreases, the flow rate of exhaust gas to be blown into the upper portion of the combustion chamber is increased or decreased in opposition to the rate of increase or decrease in the quantity of blown exhaust gas so that a flow rate of circulating exhaust gas to be introduced into the interior of the furnace is maintained within a predetermined range.

In addition, according to the present invention, a temperature at the upper furnace region is normally monitored and a flow rate of exhaust gas to be blown into the upper portion of the combustion chamber is correctly controlled in response to the upper furnace temperature so that the upper furnace temperature is maintained within the range of from 750° C. to 950° C.

Further, according to the present invention, the mixing/stirring region arranged directly above the furnace bed is formed by a throttle section of the combustion chamber.

Further, according to the present invention, a part of the exhaust gas to be fed to the mixing/stirring region is mixed with secondary air to be blown into the throttle section in a horizontal direction or in a slantwise downward direction.

Furthermore, according to the present invention, a part of the exhaust gas to be fed to the mixing/stirring region is mixed with secondary combustion air to be blown into the throttle section in the horizontal direction or in the slantwise downward direction thereby to create a swirling flow in the throttle section.

Since the flow rate of mixture gas to be fed into the combustion chamber, particularly, the mixing/stirring section is maintained within the predetermined range by blowing a part of exhaust gas depending on a variation in the quantity of combustion air, unburnt gas is stirred at the same rate irrespective of what extent the quantity of combustion air varies. Consequently, the unburnt gas effectively comes into contact wiht the combustion air, whereby the unburnt gas is effectively burnt while discharge of the unburnt gas from the furnace is reduced as far as possible.

In a case where active combustion takes place in the furnace and a quantity of secondary combustion air to be blown into the mixing/stirring region increases but a quantity of exhaust gas to be blown into the mixing/stirring region decreases, an amount of mixture gas is blown into the upper portion of the combustion chamber corresponding to the reduced quantity of exhaust gas. Consequently, combustion reaction at the upper furnace region can be activated. While combustion takes place in this manner, the temperature at the upper furnace region tends to increase. In addition, as the flow rate of the circulating exhaust gas increases, cooling is enhanced, whereby the upper furnace temperature is maintained within an optimum range at all times.

Since the upper furnace temperature is normally monitored and a quantity of exhaust gas to be blown into the upper portion of the combustion chamber is correctly controlled to maintain the upper furnace temperature within a range of from 750° C. to 950° C., the upper furnace temperature is maintained within an optimum range at all times.

Additionally, since a part of the exhaust gas is blown into the throttle section arranged directly above the furnace bed in the horizontal direction or in the slantwise downward direction to build a swirling flow in the throttle section with the resultant mixture gas comprising secondary combustion air and exhaust gas, the unburnt gas is effectively stirred irrespective of what extent the rate of unburnt gas flowing in the throttle section in the vertical direction increases. As a result, discharge of the unburnt gas from the furnace can be further reduced.

Other objects, features and advantages of the present invention will become apparent from reading the following description which has been made with reference to the accompanying drawings.

BRIEF DESCRIPTION OF THE DRAWINGS

The present invention is illustrated in the following drawings in which.

DETAILED DESCRIPTION OF THE PREFERRED EMBODIMENTS

Now, the present invention will be described in detail hereinafter with reference to the accompanying drawings which illustrate a preferred embodiment thereof.

Figure 1:
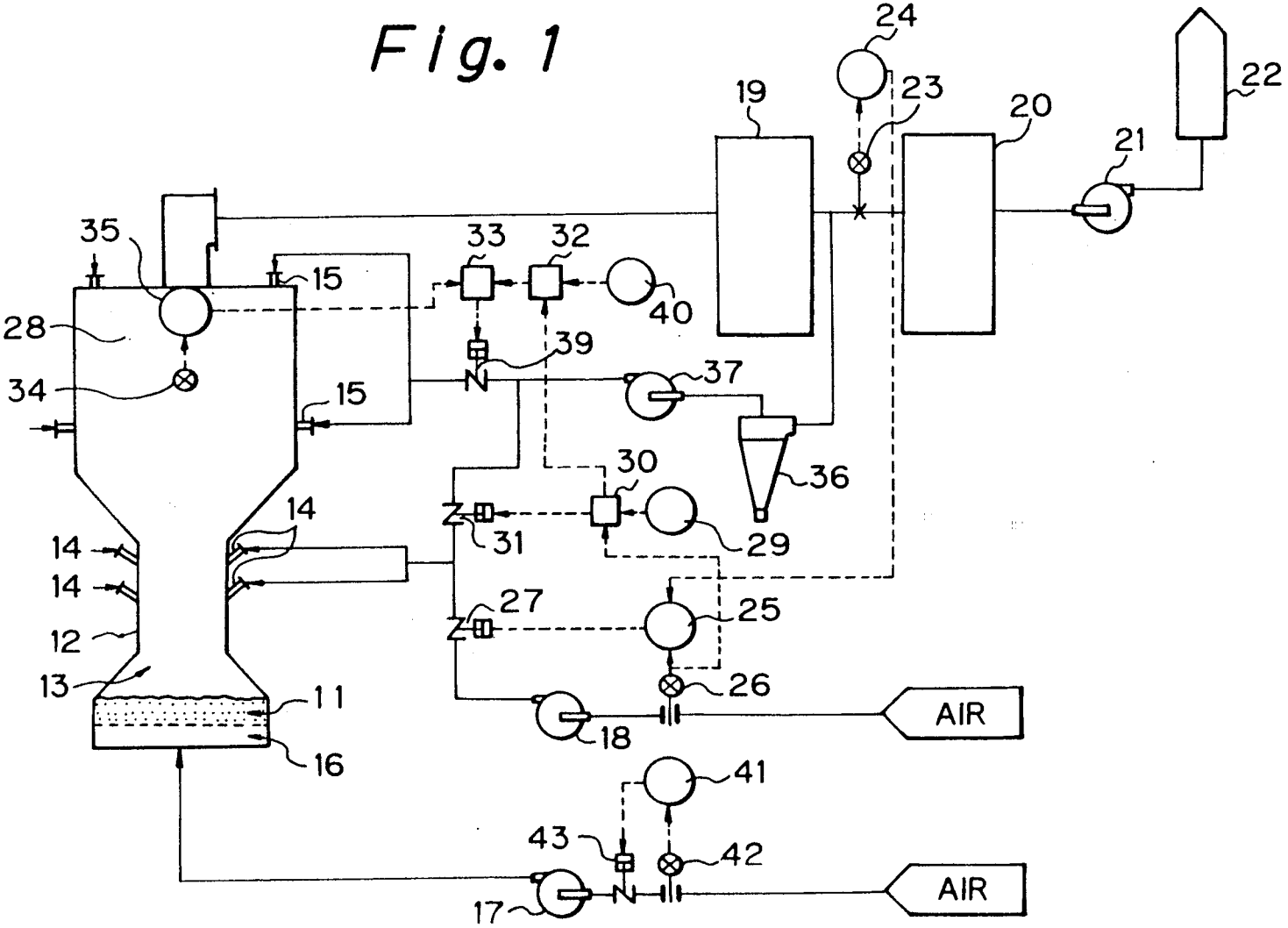
FIG. 1 is a system diagram which schematically illustrates a fluidized bed type furnace for which a method of controlling combustion in a furnace in accordance with an embodiment of the present invention is employed.

FIG. 1 is a system diagram which schematically illustrates a case where the present invention is applied to a fluidized bed type furnace or incinerator. In the drawing, reference numeral 11 designates a fluidized bed. A combustion chamber 13 is arranged directly above the fluidized bed 11, and a throttle section 12 having a small sectional area is formed at the upper end of the combustion chamber 13. The throttle section 12 is provided with a plurality of secondary combustion air feeding ports 14 on the inner wall thereof for the purpose of slantwise downwardly blowing secondary combustion air in the interior of the combustion chamber 13. In addition, a plurality of tertiary combustion air feeding ports 15 are arranged on the inner wall of an upper portion 28 of the combustion chamber and above the throttle section 12 for feeding ternary combustion air or exhaust gas therethrough. An air chamber 16 is arranged below the fluidized bed 11 so that primary combustion air is blown into the air chamber 16 via a piping which extends from an induction fan 17. As the fan 17 is rotated, primary combustion air is conveyed therefrom to enter the air chamber 16 thereby to fluidize a fluidizing medium in the fluidized bed 11. Combustible material to be burnt in the fluidized bed 11, e.g., urban refuse, industrial waste or the like is introduced into the interior of the fluidized bed 11 through a fuel feeding port (not shown) so that it is burnt therein to generate combustion gas. The combustion gas passes past the throttle section 12 in the form of a mixing/stirring region and it is then discharged from the upper portion 28. Further, the combustion gas flows through an exhaust gas cooling unit 19, an exhaust gas treating unit 20 and a suction fan 21. Finally, the combustion gas is discharged as exhaust gas into the atmosphere via a chimney 22.

Reference numeral 24 designates an oxygen density regulator for measuring a density of oxygen in the exhaust gas based on an output from an oxygen density sensor 23 thereby to control the oxygen density to a predetermined value. A control unit (not shown) compares a value indicative of an output from the oxygen density regulator 24 with an output from a flow rate sensor 26 for detecting a flow rate of secondary combustion air to be fed into the throttle section 12 under a condition that the output value of the oxygen density regulator 24 is used as a preset value for a secondary combustion air flow rate regulator 25 and then regulates a flow rate of the secondary combustion air by actuating a flow rate regulating valve 27.

Reference numeral 29 designates a mixture gas flow rate setter for setting a flow rate of mixture gas comprising secondary combustion air and exhaust gas, and reference numeral 30 designates an exhaust gas flow rate calculator for calculating a quantity of exhaust gas to be fed into the throttle section 12 based on an output from the mixture gas flow rate setter 29 and an output from the flow rate sensor 26 or an output from the mixture gas flow rate setter 29 and a set value derived from the secondary combustion air flow rate regulator 25. The exhaust gas flow rate calculator 30 serves to convert a quantity of exhaust gas into an extent of opening of a damper and moreover regulates a quantity of exhaust gas to be fed into the throttle section 12 by actuating a flow rate regulating valve 31.

Reference numeral 40 designates a circulating exhaust gas flow rate setter for setting a flow rate of exhaust gas to be circulated, and reference numeral 32 designates an exhaust gas flow rate calculator for calculating a flow rate of exhaust gas to be fed into the upper portion 28 of the combustion chamber based on an output from the circulating exhaust gas flow rate setter 40 and an output from the exhaust gas quantity calculator 30.

Reference numeral 35 designates an upper furnace temperature regulator for measuring an upper furnace temperature based on an output from a temperature sensor 34 for detecting an upper furnace temperature in order to generate an output in the form of an upper furnace temperature signal to control a flow rate of exhaust gas so as to allow the upper furnace temperature to remain with in a range of from 750° C. to 950° C., and reference numeral 33 designates a low selector for selecting the lower of two outputs, i.e., an output from the upper furnace temperature regulator 35 and an output from the exhaust gas flow rate calculator 32. The low selector 33 actuates a flow rate regulating valve 39 to regulate a flow rate of exhaust gas to be fed into the upper portion 28 of the combustion chamber. Reference numeral 36 designates a cyclone and reference numeral 37 designates an exhaust gas circulating fan.

Further, reference numeral 41 designates a primary combustion air flow rate regulator for indicating a flow rate of primary air to be fed to the lower part of the fluidized bed 11 or a certain location just above the fluidized bed 11. The primary combustion air flow rate regulator 41 measures a flow rate of primary combustion air based on an output from a flow rate sensor 42 to regulate the flow rate of primary combustion air to a preset value by actuating a flow rate regulating valve 43. With the fluidized bed type furnace as constructed in the above-described manner, the oxygen density regulator 24 compares a value derived from detection of a density of oxygen in the exhaust gas with a certain preset value and then outputs the value derived from the comparison as a preset value for the secondary combustion air regulator 25. This secondary combustion air regulator 25 calculates an excessive quantity or an insufficient quantity of secondary combustion air based on an output from the flow rate sensor 26 and an output from the oxygen density regulator 24 thereby to regulate a quantity of secondary combustion air to be fed into the throttle section 12. In a case where it is found that a quantity of secondary combustion air is reduced, the flow rate regulating valve 27 is actuated to open for the purpose of compensating a quantity of shortage. To the contrary, in a case where it is found that a quantity of secondary combustion air becomes excessive, the flow rate regulating valve 27 is actuated in the reverse direction to the foregoing case to reduce the flow rate of secondary combustion air.

The exhaust gas flow rate calculator 30 calculates a flow rate of exhaust gas to be fed into the throttle section 12 based on an output from the flow rate sensor 26 and an output from the mixture gas flow rate setter 29 or an output from the mixture gas flow rate setter 29 and a set value derived from the secondary combustion air regulator 25 and then regulates a quantity of exhaust gas to be fed into the throttle section 12. In a case where it is found that a quantity of secondary combustion air has increased, the flow rate generating valve 31 is actuated in the direction of closing to reduce a flow rate of exhaust gas in opposition to the increased quantity of secondary combustion air. To the contrary, in a case where it is found that a quantity of secondary combustion air has been reduced, the flow rate regulating valve 31 is actuated in the direction of opening to increase a flow rate of exhaust gas corresponding to the reduced quantity of secondary combustion air. In this manner, a flow rate of gas passing through the throttle section 12 is normally held at a level of the flow rate which has been set by the mixture gas flow rate setter 29.

The exhaust gas flow rate calculator 32 calculates an insufficient quantity of flow rate of an exhaust gas to be circulated based on an output from the exhaust gas flow rate calculator 30, i.e., a flow rate of the exhaust gas to be fed into the throttle section 12 and an output from the circulating exhaust gas flow rate setter 40 and then actuates the flow rate regulating valve 39 thereby to regulate a flow rate of the exhaust gas to be fed into the upper portion 28 of the combustion chamber. Namely, in a case where a quantity of exhaust gas to be fed into the throttle section 12 via the flow rate regulating valve 31 is reduced, the flow rate regulating valve 39 is actuated in the direction of opening to increase a flow rate of exhaust gas corresponding to the reduced quantity of exhaust gas so as to allow the increased quantity of exhaust gas to be fed into the upper portion 28 of the combustion chamber. To the contrary, in a case where a quantity of exhaust gas to be fed into the throttle section 12 is increased, the flow rate regulating valve 31 is actuated in the reverse direction to the foregoing case to reduce the flow rate of exhaust gas corresponding to the increased quantity of exhaust gas. Thus, a quantity of exhaust gas to be circulated is controlled to coincide with the quantity of exhaust gas to be circulated which has been set by the circulating exhaust gas flow rate setter 40. The low selector 33 selects the lower of two outputs, i.e., an output from the furnace top temperature regulator 35 and an output from the exhaust gas flow rate calculator 32 and then actuates the flow rate regulating valve 39 in response to the selected output. Thus, e.g., in a case where a flow rate of exhaust gas to be fed into the upper portion 28 of the combustion chamber 13 is increased and thereby the upper furnace temperature is reduced to be lower than the lower limit of the optimum range (750°-950° C.), the control unit operates to reduce a flow rate of circulating exhaust gas to be fed into the upper portion 28 of the combustion chamber thereby to prevent the working temperature from being excessively reduced.

During such a control operation as described above, e.g., when a density of oxygen in the exhaust gas is elevated, the flow rate regulating valve 27 is actuated in the direction of closing to reduce a flow rate of secondary air. Then, the exhaust gas flow rate calculator 30 serves to actuate the flow rate regulating valve 41 in the direction of opening thereby to increase the flow rate of exhaust gas to be circulated corresponding to the reduced quantity of secondary air. Consequently, a flow rate of mixture gas comprising secondary air to be fed via the secondary combustion air feeding ports 14 and exhaust gas is kept substantially constant irrespective of what extent the quantity of secondary combustion air varies corresponding to variation in the oxygen density. Therefore, a stirring state of the gas which is left unburnt in the throttle section 12 is kept substantially constant irrespective of variation of a quantity of secondary combustion air (i.e., quantity of air required for combustion).

Generally, when a quantity of exhaust gas is reduced to zero and only secondary combustion air is fed through the secondary combustion air feeding ports 14, the flow speed of air fed through the secondary combustion air feeding ports 14 remains at a level of about 40 m/s, and as the density of oxygen in the exhaust gas increases, the flow rate of secondary air is reduced. Thus, in some cases, the flow speed of air fed through the secondary combustion air feeding ports 14 may be reduced. At this time, a stirring/mixing state of the unburnt gas in the throttle section 12 deteriorates with the result that the unburnt gas is discharged to the outside as it is. To prevent the foregoing undesirable process from taking place, the flow rate sensor 26 detects that the flow rate of secondary combustion air to be fed into the throttle section 12 is reduced and then the control unit operates to actuate the flow rate regulating valve 31 in the direction of opening via the exhaust gas flow rate calculator 30 thereby to increase the flow rate of the circulating exhaust gas corresponding to the reduced quantity of secondary combustion air. Thus, since the flow rate of the mixture gas to be fed into the throttle section 12 is kept substantially constant, combustion gas and combustion air are normally stirred together under the effect of a constant magnitude of stirring power, whereby unburnt gas is effectively brought into constant with the combustion gas, resulting in discharge of the unburnt gas into the atmosphere being kept to a minimum. Consequently, in constrast with the conventional fluidized bed type furnace, the fluidized bed type furnace of the present invention wherein a density of oxygen in a combustion gas is measured and a quantity of combustion air is correctly controlled so as not to cause excess or shortage of oxygen, assures that unburnt gas is not discharged to the outside.

In addition, since the fluidized bed type furnace of the present invention is provided with the mixture gas flow rate setter 29 so as to allow secondary combustion air to be preferentially fed into the throttle section 12, there is no danger that the oxygen density will be excessively reduced in the throttle section 12 where mixing/stirring is achieved with combustion gas. As combustion is activated and thereby a flow rate of secondary combustion air to be fed into the throttle section 12 increases, exhaust gas which has become useless is fed into the upper portion 28 of the combustion chamber, enabling a combustion reaction to take place in the upper furnace region. When combustion takes place in that way, the upper furnace temperature tends to increase. At this time, the upper furnace region is cooled by increasing the flow rate of exhaust gas, whereby the upper furnace temperature is maintained within an optimum range. If the upper furnace temperature is reduced to the lower than the lower limit of the optimum range (750°-950° C.), the flow rate of exhaust gas to be fed into the upper portion 28 of the combustion chamber is accordingly reduced to prevent the upper furnace temperature from being excessively lowered.

Figure 2:
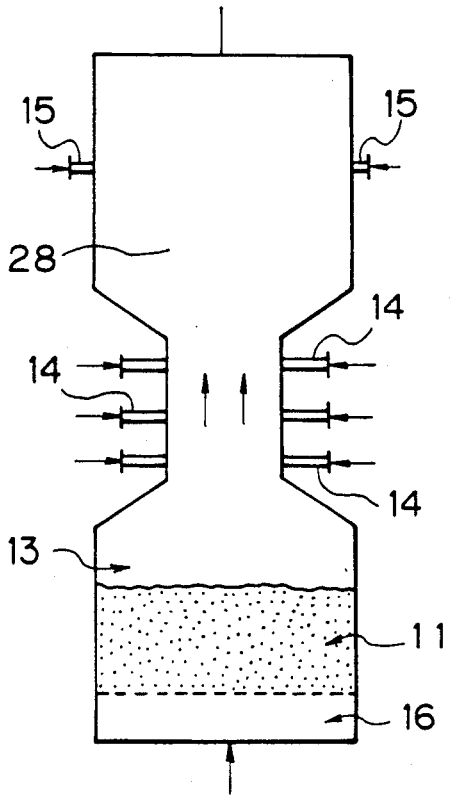
FIG. 2 is a vertical sectional view which schematically illustrates another arrangement of a plurality of secondary combustion air feeding ports for the fluidized bed type furnace in FIG. 1.

According to the aforementioned embodiment of the present invention, secondary combustion air or mixture gas comprising secondary combustion air and exhaust gas is slantwise downwardly blown into the throttle section 12 through the secondary combustion air feeding ports 14 to enhance stirring intensity. Alternatively, as shown in FIG. 2, secondary combustion air or mixture gas comprising secondary combustion air and exhaust gas may, of course, be horizontally blown into the throttle section 12 through a plurality of secondary combustion air feeding ports 14 which are arranged in a horizontal attitude, although, to some extent, this cause a lowering of stirring intensity.

Figure 3:
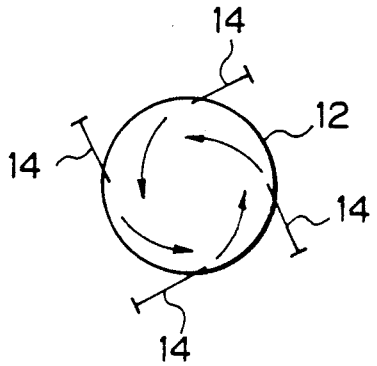
FIG. 3 is a cross-sectional view which schematically illustrates a flow of gas blown in a throttle section of the fluidized bed type furnace.

Additionally, as shown in FIG. 3, to make sure that secondary combustion air or mixture gas comprising secondary combustion air and exhaust gas which has been blown into the throttle section 12 in a slantwise downward direction or in a horizontal direction builds a swirling flow, the secondary combustion air feeding ports 14 may be arranged to extend in the tangential direction relative to the inner wall surface of the furnace as seen in a cross-sectional plane. With such an arrangement, the advantageous effect derived from the stirring intensity can be further enhanced.

According to the aforementioned embodiment of the present invention, the secondary combustion air feeding ports 14 are arranged in two stages positionally offset in the vertical direction of the furnace. However, the present invention should not be limited only to this. Alternatively, the secondary combustion air feeding ports 14 may be arranged in a single stage or in a plurality of stages positionally offset from each other in the vertical direction of the furnace. In addition, arrangement may be made such that gas blown in the throttle section 12 through the secondary air feeding ports 14 arranged in plural stages build a swirling flow.

According to the aforementioned embodiment of the present invention, exhaust gas to be circulated is blown into the throttle section 12 while mixing with secondary air, resulting in the furnace becoming complicated in structure. Alternatively, exhaust gas to be circulated may be blown in the throttle section 12 through exhaust gas feeding port(s) which are arranged separately from the secondary combustion air feeding ports 14.

According to the aforementioned embodiment of the present invention, an operative region where combustion gas is mixed and stirred is designed in the form of a throttle section having a small sectional area. The mixing/stirring region should not be limited only to this configuration. The mixing/stirring region is not necessarily required to have a small cross-sectional area, provided that it is proven that mixing/stirring is achieved with excellent efficiency.

Further, according to the aforementioned embodiment of the present invention, the present combustion state in the furnace is detected by measuring the density of oxygen in exhaust gas by the oxygen density sensor 23 and the oxygen density regulator 24. However, detecting means for detecting the present combustion state in the furnace should not be limited only to the above-described arrangement. Alternatively, in view of the fact that brightness and pressure in the furnace vary depending on the combustion state (e.g., as long as combustion takes place actively, brightness and pressure in the furnace are kept high, but when combustion does not take place actively, brightness and pressure in the furnace are reduced), the present combustion state in the furnace may be sensed by detecting the level of brightness and pressure in the furnace. Further, since the combustion state in the furnace is correlated to the furnace temperature, the combustion state in the furnace may be sensed by detection the furnace temperature. In this case, however, there occurs a time delay which may lower the effectiveness derived from detection of the combustion state in the furnace.

While the present invention has been described above with respect to the embodiment wherein the method of the present invention is applied to the fluidized bed type furnace, it should, of course, be understood that the method of the present invention should not be limited only to a fluidized bed type furnace.

Figure 4:
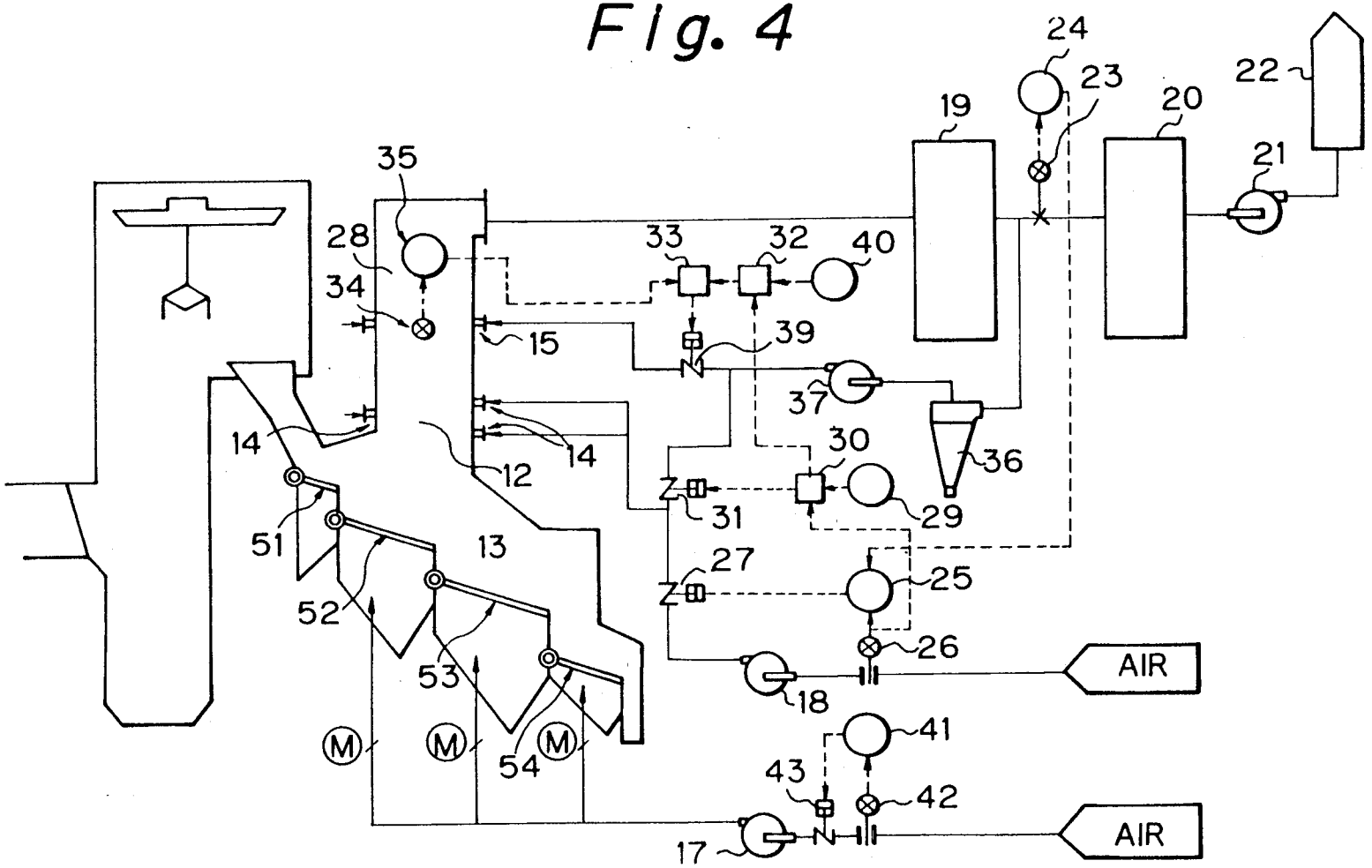
FIG. 4 is a system diagram which schematically illustrates a furnace of the type including a stoker type furnace bed for which the method of the present invention is employed.

FIG. 4 is a system diagram which schematically illustrates a furnace or an incinerator of the type including a stoker type furnace bed for which the method of controlling combustion in the furnace according to the present invention is employed. The same or similar components in the drawing as those in FIG. 1 are represented by same reference numerals. Since these components have the same operative function as that of the components in FIG. 1, repeated description will not be made.

In FIG. 4, reference numeral 12' designates a mixing/stirring region and reference numeral 28 designates an upper portion of a combustion chamber 13. Further, reference numeral 51 designates a feeder, reference numeral 52 designates a drying stoker, reference numeral 53 designates a combustion stoker and reference numeral 54 designates a post-combustion stoker.

Operation of the combustion system as shown in FIG. 4 is substantially identical to that of the fluidized bed type combustion system which has been described above with reference to FIG. 1. Therefore, repeated description will not be made.

As will be apparent from the above description, the method of controlling combustion in a furnace according to the present invention has the following advantageous effects.

(1) According to the present invention, a gas flow speed in the mixing/stirring region is maintained within a predetermined range by blowing a part of exhaust gas into the mixing/stirring region depending on the variation in the quantity of combustion air. Thus, combustion gas is stirred at a constant rate in a furnace wherein a quantity of combustion air is controlled by measuring the density of oxygen in an exhaust gas so as not to cause an excessive or insufficient supply of oxygen, irrespective of the quantity of combustion air which has been blown into the interior of the furnace. Consequently, unburnt gas is effectively brought into contact with the combustion air with the result that discharge of unburnt gas into the atmosphere can be minimized.

(2) According to the present invention, when a quantity of secondary combustion air to be fed into the mixing/stirring region increases, exhaust gas which has become useless is fed into the upper portion of the combustion chamber, whereby combustion reaction in the upper furnace region can be activated. As combustion becomes activated in this way, the temperature in the upper furnace region tends to increase. In addition, as the flow rate of exhaust gas to be blown into the upper portion of the combustion chamber increases, the upper furnace region can be effectively cooled. As a result, the upper furnace temperature can be maintained within an optimum range.

(3) Further, according to the present invention, the upper furnace temperature is normally monitored and a quantity of exhaust gas to be blown into the upper portion of the combustion chamber is correctly controlled such that the upper furnace temperature is maintained within a range of from 750° C. to 950° C. Consequently, the upper furnace temperature can normally be maintained with an optimum range.

While the present invention has been described above merely with respect to two preferred embodiments thereof, it should be noted that the present invention should not be limited only to them but various changes or modifications may be made without departure from the scope of the appended claims.

What is claimed is:

1. In a method of controlling combustion in a fluidized bed type furnace having a combustion chamber, the lower portion of the combustion chamber being a mixing/stirring region in which unburnt gas and secondary combustion air are mixed and stirred together, said furnace being supplied with a quantity of combustible material varying per unit time and a quantity of combustion air which is controlled in response to the quantity of the combustible material, the improvement wherein a flow rate of mixture gas comprising secondary combustion air and exhaust gas to be fed into the mixing/stirring region is maintained within a predetermined range by blowing a part of exhaust gas into the mixing/stirring region depending on variation in said quantity of combustion air.

2. The method as claimed in claim 1, wherein when a part of exhaust gas is also blown into the upper portion of the combustion chamber, and when a quantity of exhaust gas to be blown into the mixing/stirring region increases or decreases, the flow rate of exhaust gas to be blown into the upper portion of the combustion chamber is decreased or increased in opposition to the quantity of said increase or decrease of the blown exhaust gas so that a flow rate of the circulating exhaust gas to be introduced into the furnace is maintained within a predetermined range.

3. The method as claimed in claim 2, wherein a temperature at the upper furnace region is normally monitored and the flow rate of exhaust gas to be blown into the upper portion of the combustion chamber is correctly controlled in response to said upper furnace temperature so that said upper furnace temperature is maintained within a range of from 750° C. to 950° C.

4. The method as claimed in any one of claims 1 to 3, wherein the mixing/stirring region is formed by a throttle section of the combustion chamber.

5. The method as claimed in any one of claims 1 to 3, wherein the part of exhaust gas to be fed to the mixing/stirring region is mixed with secondary air to be blown into a throttle section of the combustion chamber in the horizontal direction or in the slantwise downward direction.

6. The method as claimed in any one of claims 1 to 3, wherein the part of the exhaust gas to be fed to the mixing/stirring region is mixed with secondary combustion air to be blown into a throttle section of the combustion chamber in the horizontal direction or in the slantwise downward direction thereby to create a swirling flow in the throttle section.

* * * * *